United States Patent [19]

Bockelmann et al.

[11] 4,078,024

[45] Mar. 7, 1978

[54] CARBURETOR FOR INTERNAL COMBUSTION ENGINE

[75] Inventors: Wilfried Bockelmann, Buttgen; Georg Faltermeier, Wolnzach, both of Germany

[73] Assignee: Societe Industrielle de Brevets et d'Etudes S.I.B.E., France

[21] Appl. No.: 784,696

[22] Filed: Apr. 5, 1977

[30] Foreign Application Priority Data

Apr. 23, 1976 France ..... 76 12111

[51] Int. Cl.[2] ..... F02M 1/10

[52] U.S. Cl. ..... 261/39 B; 91/416; 123/119 F

[58] Field of Search ..... 261/39 B; 123/119 F

[56] References Cited

U.S. PATENT DOCUMENTS

| | | | |
|---|---|---|---|
| 2,408,104 | 9/1946 | Stanton | 261/39 B |
| 3,831,567 | 8/1974 | Freismuth et al. | 261/39 B |
| 3,872,847 | 3/1975 | Charron et al. | 261/39 B |
| 3,991,731 | 11/1976 | Benjamin | 261/39 B |

FOREIGN PATENT DOCUMENTS

| | | | |
|---|---|---|---|
| 2,286,950 | 4/1976 | France | 261/39 B |
| 2,523,532 | 12/1975 | Germany | 261/39 B |

*Primary Examiner*—Tim R. Miles

*Attorney, Agent, or Firm*—Stevens, Davis, Miller & Mosher

[57] ABSTRACT

A carburetor has an operator operable butterfly valve and an auxiliary throttle located upstream of the butterfly valve. The auxiliary throttle is urged toward closure by temperature sensitive thermostatic means and is urged toward opening by the airflow drawn by the engine. A pneumatic element subjected to the pressure downstream of the butterfly valve opens the auxiliary throttle to a predetermined extent immediately after cranking. A pneumatic device responsive to the depression downstream of the butterfly valve urges the auxiliary throttle toward closure when the butterfly valve is abruptly opened while the engine is cold. The action of that pneumatic device is of short duration, and consequently the auxiliary throttle returns to its partially open position as acceleration proceeds.

6 Claims, 2 Drawing Figures

CARBURETOR FOR INTERNAL COMBUSTION ENGINE

BACKGROUND AND SUMMARY OF THE INVENTION

This invention relates to internal combustion engine carburettors comprising a starting device for improving the operation of the engine during the period after cranking.

It relates more particularly to carburettors having, located in the intake pipe, successively, in the direction opposite to that of air flow: operator operable main throttle means actuated by the user; a main fuel jetting system; and auxiliary throttle means urged in the closing direction by thermostatic means sensitive to the engine temperature when the engine temperature is less than a predetermined limit and urged in the opening direction by the air flow inspired by the carburettor and by a pneumatic element subjected to the pressure which prevails in the intake pipe, downstream of the main throttle means at least when said throttle means is in its minimum opening position, and constructed to open the auxiliary throttle means to a predetermined extent.

Usually such carburettors also comprise auxiliary means for preventing the main throttle means from closing to less than a minimum aperture which depends on the engine temperature, such as a "fast idle" cam (French Pat. No. 1,302,536).

In starting devices of this kind, a considerable depression prevails at the outlet of the main jetting system when the auxiliary throttle means (usually an eccentric throttle valve) is closed by the thermostatic means and the air fuel-mixture is quite rich while the motor is being driven by the starter. As soon as the engine becomes self-operative, the richness has to be rapidly decreased to prevent the engine flooding and stalling. For this purpose, the throttle valve has to be opened to a certain extent; this is done by the depression which builds up downstream of the main throttle means and which acts on the pneumatic element urging the starting valve in the opening direction. Similar carburettors are described in U.S. Pat. No. 2,348,544 (Jorgensen) and French Pat. No. 748,586. However, the pneumatic element disclosed in Jorgensen does not adjust a position, but changes the torque exerted by a thermostatic member. In the French patent, a pneumatic piston is provided, but its actuating linkage comprises a bimetallic spiral.

Most prior art starting devices of that type do not operate satisfactorily if the main throttle means is opened abruptly immediately after starting the engine when cold. Assuming the engine has just been cranked, while the main throttle means is in its minimum opening position, the pneumatic element partly opens the start valve. If, in order to accelerate the engine, the main throttle means is then opened beyond the minimum opening position determined by the "fast idle" cam and corresponding to the engine temperature, the flow rate of air through the intake pipe increases without a corresponding increase in the amount of fuel supplied by the main jetting system. Consequently, the air-fuel mixture supplied to the engine becomes leaner and engine operation becomes faulty.

It is an object of the invention to provide a carburettor comprising an improved starting device whose operation is more satisfactory than the existing devices. It is a more particular object to provide a carburettor which supplies to the engine a richer mixture immediately after the aforementioned opening of the main throttle valve after cranking, before the engine has reached its normal operating temperature.

According to an aspect of the invention, there is provided a carburettor comprising an additional pneumatic device which is actuated by the depression downstream of the main throttle means and is operatively associated with the auxiliary throttle means, whereby, when the main throttle means is abruptly opened while the engine is cold, the pneumatic device urges the auxiliary throttle means in the closing direction temporarily.

The pneumatic device typically comprises a main diaphragm connected to the auxiliary throttle means by a unidirectional or one-way mechanical connection whereby the pneumatic device can urge the auxiliary throttle means in the closing direction only, which diaphragm separates a chamber connected to a portion of the intake pipe which passes from downstream to upstream of the main throttle means when the throttle means is opened beyond its minimum opening position, from a second chamber communicating with the first chamber via a calibrated orifice. Advantageously, the second chamber is also connected to the first chamber by a non-return valve which opens when the depression in the first chamber is greater than the depression in the second chamber. The second chamber may be separated from atmosphere by an auxiliary diaphragm.

The main and auxiliary diaphragms form a movable unit which advantageously is biased by a return spring to an inoperative position where it does not exert any action on the auxiliary throttle means.

The invention will be better understood from the following description of a downdraught carburettor comprising a starting device and constituting an embodiment of the invention, given by way of non-limitative example. The description refers to the accompanying drawings.

SHORT DESCRIPTION OF THE DRAWINGS

FIG. 1 is a diagrammatic vertical section through the carburettor, the various elements being shown in the position which they occupy when the engine is cold, immediately after cranking;

FIG. 2, similar to FIG. 1, shows the carburettor after the engine starts, at the same temperature as in FIG. 1, when the main throttle means has been opened beyond the minimum opening position imposed by the ambient temperature.

DESCRIPTION OF A PREFERRED EMBODIMENT

Figure 1:
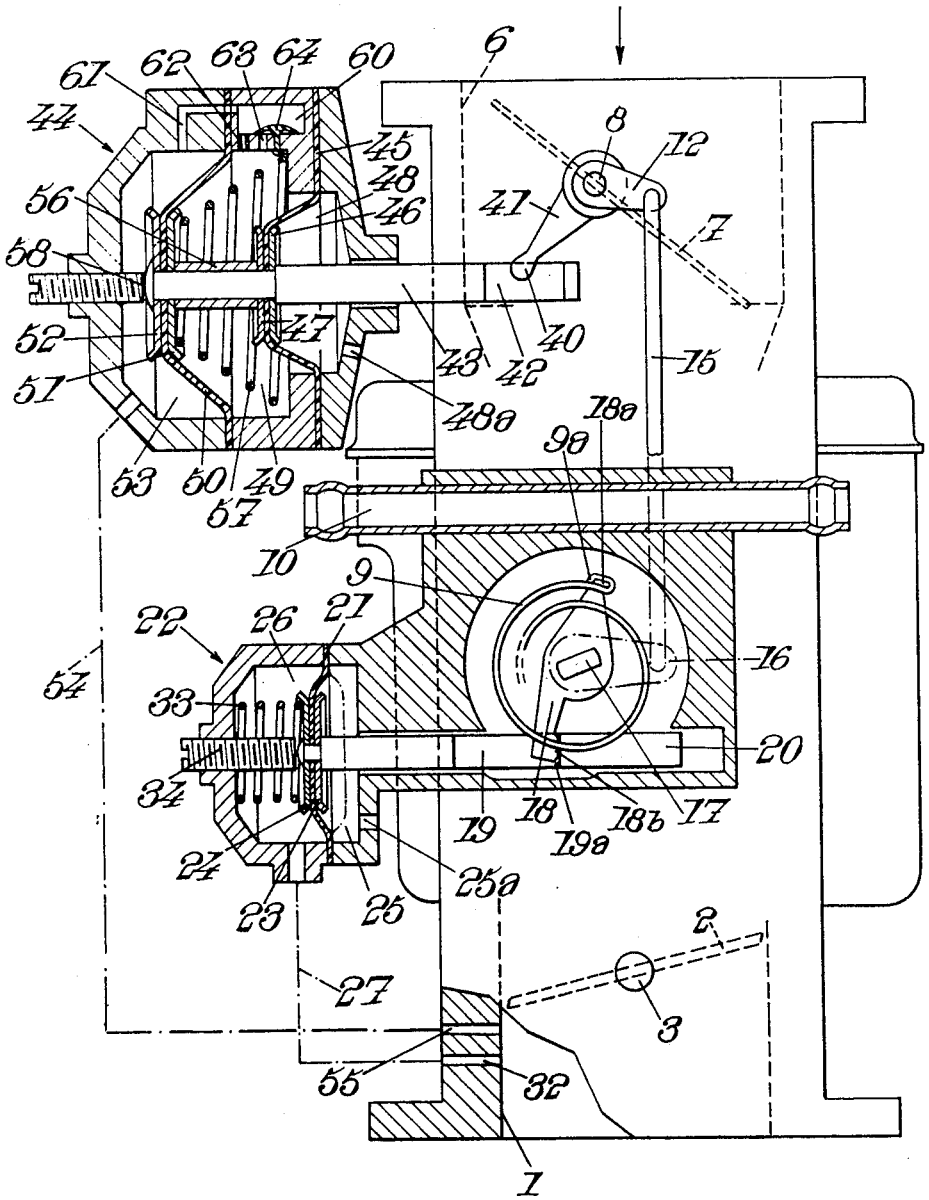

Referring to the drawings, there is shown a carburettor comprising the following components in the intake pipe 1, from downstream to upstream:

- main throttle means 2 consisting of a butterfly valve carried by a shaft 3 which is actuatable by an operator,
- a main fuel jetting system which delivers fuel emulsified with air (not shown) and opens at a venturi, and
- an auxiliary throttle means 7 located in the air inlet 6 of the intake pipe 1 and comprising an eccentric start throttle or choke valve secured to a shaft 8 fast with a lever 12.

Auxiliary means (not shown) are provided which adjust the minimum extent to which the butterfly valve is open in dependence on the engine temperature. The last-mentioned means may comprise a fast idle cam actuated by temperature-sensitive means (not shown).

Figure 2:
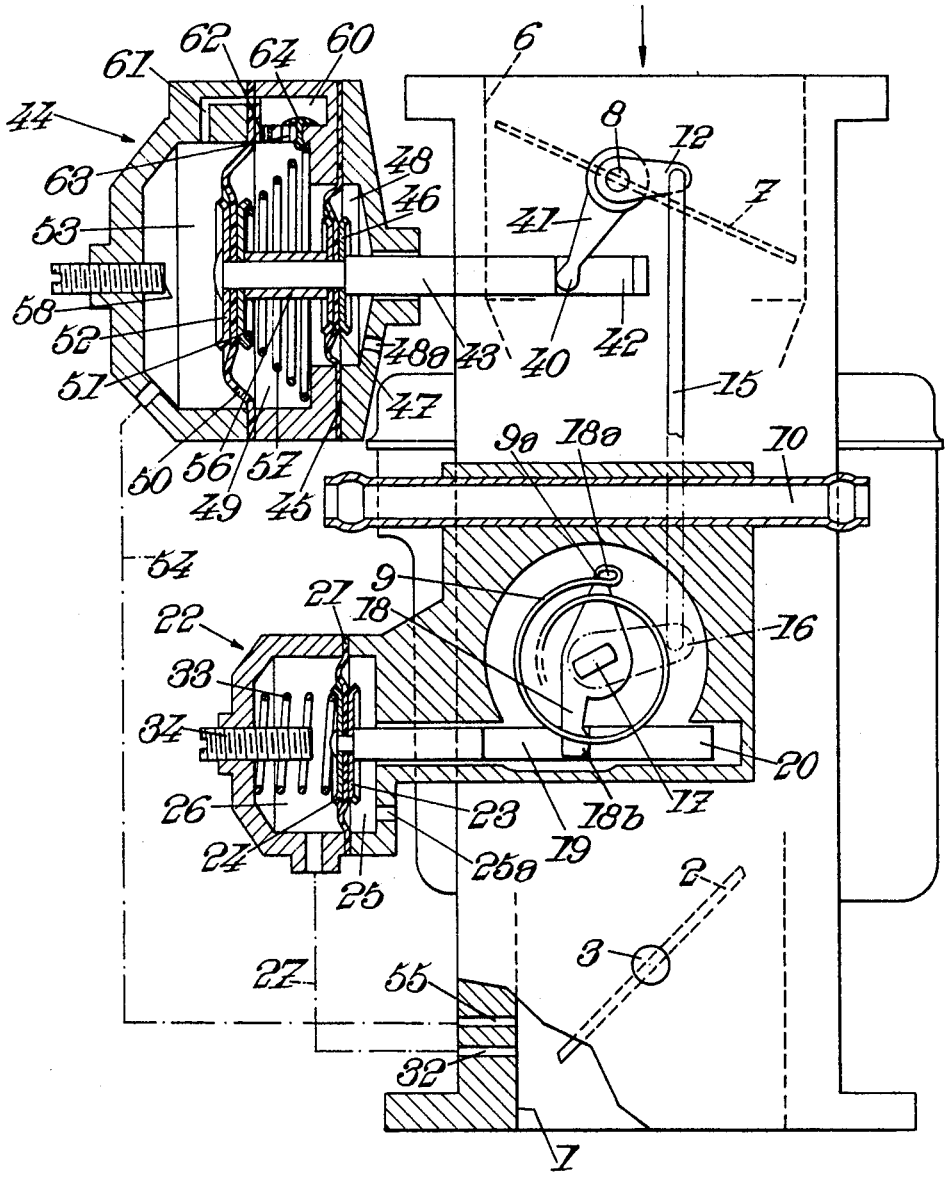

Lever 12 is connected by a rod 15 to a lever 16 secured to a shaft 17 and to a lever 18 formed with a lug 18*a* cooperating with the free outer end 9*a* of thermostatic means such as a bimetallic spiral 9, part of which is shown in FIGS. 1 and 2. Spiral 9 is constructed so that its free end 9*a* moves in the clockwise direction when the spiral is heated. It is disposed in a chamber bounded by a casing (not shown) secured to the carburettor body, and its inner end is secured to a projection on the casing. Spiral 9 is brought by heating means to a temperature representing the engine temperature. The heating means can be air which has flown along the engine exhaust manifold, engine cooling water flowing in a duct 10 (as shown in FIGS. 1 and 2), or an electric resistor. End 18*b* of the lever is retained in a recess 19 of a rod 20 coupled to diaphragm 21 of a pneumatic element or capsule 22, so that the end shoulder 19*a* of the recess can bear on end 18*b* and move lever 18 in the direction for opening the auxiliary throttle means 7.

Diaphragm 21 divides the casing of pneumatic element 22 in two compartments 25 and 26. Compartment 25 is connected to atmosphere by an orifice 25*a*. Compartment 26 is connected by a connecting duct 27 to a place 32 along the intake pipe 1 which is downstream of butterfly valve 2 when the valve is in its minimum opening position, irrespective of the temperature (i.e. within the range of temperature for which the carburettor is designed to operate). The central part of diaphragm 21 is clamped between cup-shaped members 23, 24 which are subjected by a spring 33 to a return force which opposes the force resulting from the pressure differential across diaphragm 21 and biasing the diaphragm toward the position shown in chain-dotted lines in FIG. 1.

In the illustrated embodiment, the end stud 40 of a lever 41 secured to shaft 8 of valve 7 cooperates with a recess 42 in a push rod 43 of a pneumatic device 44 having a casing made up of several parts which are assembled and secured to the carburettor body. Recess 42 is disposed and dimensioned so that lever 41 can escape from it when the auxiliary throttle means is opened beyond a predetermined extent, which is slightly above the extent shown in FIG. 1.

Rod 43 is connected to a movable assembly of device 44. The movable assembly comprises:

- an auxiliary diaphragm 45 clamped between two rigid cup-like members 46 and 47 and separating a first chamber 48, connected to atmosphere by an orifice 48*a*, from a second chamber 49, and
- a main diaphragm 50 clamped between two rigid cup-shaped members 51, 52 and separating the second chamber 49 from a third chamber 53 connected to the part of the intake pipe 1 located downstream of valve 2 by a connecting duct 54 opening through an orifice 55.

Orifice 55 is formed slightly upstream of orifice 32. Consequently, orifice 55 passes upstream of the edge of valve 2 before orifice 32 upon progressive opening of valve 2. But it is downstream of the edge when valve 2 is in the minimum opening position. In another embodiment (not shown), orifices 32 and 55 are combined.

A tubular spacer 56 maintains a constant spacing between cup-shaped members 47 and 51. A spring 57, which is compressed between member 51 and a shoulder of the casing in chamber 49, biases the movable assembly to the left in FIGS. 1 and 2, toward a position determined by an adjustable abutment 58.

The third chamber 53 is connected by a duct 61 to a chamber 60 formed inside the wall of the casing of the pneumatic device 44. Chamber 60 has a permanent connection with the second chamber 49 via a small-sectional area calibrated orifice 62 and is also connected to chamber 49 via an orifice 63 of large flow cross-section provided with a non-return valve 64 which allows air to flow from chamber 49 to chamber 53 but not in the opposite direction.

The device operates as follows:

Immediately after cranking of the cold engine, the components are in the position shown in FIG. 1. The depression in the part of pipe 1 downstream of valve 2 is transmitted to compartment 26 by duct 27, and diaphragm 21 moves until member 24 is in contact with abutment screw 34. Rod 20 draws end 18*b* of lever 18 and partly opens the auxiliary throttle means 7 to a predetermined extent which can be adjusted by means of screw 34.

The depression downstream of valve 2 is likewise transmitted by duct 54 to the third chamber 53 and thence to the second chamber 49 via duct 61, chamber 60 and the orifice 63 of large cross-sectional area which is in parallel with the calibrated restricted orifice 62. Thereupon, both faces of diaphragm 50 are subjected to the same pressure and the diaphragm does not exert a force on push rod 43 coupled thereto. Under these conditions, the combined action of the depression in chamber 49 on diaphragm 45 and spring 57 maintains rod 43 in contact with screw 58.

When rod 43 is in the last-mentioned position, the recess 42 leaves stud 40 free to move under the action of pneumatic element 22 in the direction for opening the auxiliary throttle means 7.

If the operator then opens valve 2 to a greater extent that the minimum opening corresponding to the temperature conditions at that time and moves valve 2 beyond orifice 55, the depression in the third chamber drops abruptly. On the other hand, the depression in the second chamber 49 decreases only slowly, since air travels only through the orifice 62 of small sectional flow area. The effective area of action of the pressure on diaphragm 50 is greater than those of diaphragm 45 and diaphragm 21, so that the resultant pressure force on the movable element pushes it, compressing spring 57 and moving diaphragm 21 to the right in FIGS. 1 and 2. The left edge of recess 42 contacts stud 40 and pushes it, so that valve 7 is opened to a smaller extent than shown in FIG. 1. Since valve 7 is further closed, there is an increase in the depression on the main jetting system and the air-fuel mixture supplied to the engine is enriched as required.

The pressure in chamber 49 increases, since air enters through the calibrated orifice 62 of small cross-section, the pressure on the main diaphragm 50 decreases until the combined effect of spring 57 and of the depression in chamber 49 on the auxiliary diaphragm 45 again becomes preponderant. Rod 43 is again forced to the left and valve 7 reopens and returns to the position in FIG. 1. The time duration of the enrichment produced by device 44 is mainly dependent on the volume of chamber 49 and the flow cross-section of orifice 62, i.e. it varies in inverse relation with the last-mentioned flow cross-section.

Usually, the dimensions of the chambers and the cross-section of orifice 62 are made such that the auxiliary throttle means 7 returns to its original position in a time of about 1–6 seconds.

The position of the left edge of recess 42 of rod 43 is typically chosen so that, when the engine has heated to beyond a predetermined temperature, stud 40 escapes from the recess of push rod 43 and is not actuated thereby during acceleration (FIG. 1).

Alternatively, device 44 can be rendered inoperative by closing the connecting duct 54 as soon as the engine reaches a given temperature, e.g. by means of a solenoid valve actuated by a thermal contactor sensitive to the engine temperature.

The device according to the invention provides a simple method of temporarily enriching the air-fuel mixture supplied to the engine during acceleration, until the engine reaches a predetermined temperature.

We claim:

1. A carburettor for internal combustion engine comprising, in an intake pipe, successively, in the direction opposite to that of air flow: operator operable main throttle means actuated by the user; a main fuel jetting system; an auxiliary throttle means urged in the closing direction by thermostatic means sensitive to the engine temperature when the engine temperature is less than a predetermined limit and urged in the opening direction by the air flow inspired by the carburettor and by a pneumatic element subjected to the pressure which prevails in the intake pipe, downstream of the main throttle means at least when said throttle means is in its minimum opening position, and constructed to open the auxiliary throttle means to a predetermined extent, said carburettor further comprising a pneumatic device which is actuatable by the depression downstream of the main throttle means and is operatively associated with the auxiliary throttle means whereby, when the main throttle means is opened while the engine is cold, the pneumatic device urges it in the closing direction with a force which decreases with time.

2. A carburettor according to claim 1, wherein the pneumatic device comprises a main diaphragm connected to the auxiliary throttle means by a unidirectional mechanical connection whereby the pneumatic device can urge the auxiliary throttle means in the closing direction only, which main diaphragm separates a chamber connected to a portion of the intake pipe which passes from downstream to upstream of the main throttle means, when the main throttle means is opened beyond its minimum opening position, from a second chamber via a calibrated restricted orifice.

3. A carburettor according to claim 2, wherein the second chamber is also connected to the first chamber via a non-return check valve which opens when the depression in the first chamber is greater than the depression in the second chamber.

4. A carburettor according to claim 2, wherein the second chamber is separated from atmosphere by an auxiliary diaphragm and the effective area of action of the depression on the auxiliary diaphragm is smaller than that on the main diaphragm, the two diaphragms being connected to form a single movable unit.

5. A carburettor according to claim 2, further comprising a spring subjecting the main diaphragm to a force tending to return it to a position where it does not exert any action on the auxiliary throttle means.

6. A carburettor according to claim 1, wherein the pneumatic element is coupled to the auxiliary throttle means by a positive unidirectional connection preventing the auxiliary throttle means from closing beyond a predetermined minimum extent.

* * * * *